US006003249A

United States Patent [19]

Watson

[11] Patent Number: 6,003,249

[45] Date of Patent: Dec. 21, 1999

[54] SNOWSHOE WITH INTEGRALLY MOLDED AND SUPPORTED HINGE PIN

[75] Inventor: Jim Watson, Grand Junction, Colo.

[73] Assignee: Spring Brook Manufacturing, Inc., Grand Junction, Colo.

[21] Appl. No.: 09/259,712

[22] Filed: Mar. 1, 1999

[51] Int. Cl.[6] ..... A43B 5/04

[52] U.S. Cl. ..... 36/124; 36/122

[58] Field of Search ..... 36/122–125, 116

[56] References Cited

U.S. PATENT DOCUMENTS

| | | | |
|---|---|---|---|
| 1,523,222 | 1/1925 | Leet . | |
| 2,097,249 | 10/1937 | Keene | 36/4.5 |
| 2,615,260 | 10/1952 | Paden | 36/122 |
| 3,299,541 | 1/1967 | Snyder | 36/4.5 |
| 3,638,333 | 2/1972 | Sprandel | 36/4.5 |
| 3,673,713 | 7/1972 | Fedewitz | 36/2.5 |
| 3,755,926 | 9/1973 | Schonbrun | 36/2.5 |
| 4,004,355 | 1/1977 | Koblick | 36/122 |
| 4,228,601 | 10/1980 | Lawton et al. | 36/124 |
| 4,344,238 | 8/1982 | Peyser | 36/62 X |
| 4,525,939 | 7/1985 | McNeil et al. | 36/62 X |
| 4,604,817 | 8/1986 | Ramboz | 36/125 |
| 5,014,450 | 5/1991 | McGrath | 36/124 |
| 5,459,950 | 10/1995 | Damm et al. | 36/122 |
| 5,809,668 | 9/1998 | Kiniry et al. | 36/122 |

FOREIGN PATENT DOCUMENTS

| | | | |
|---|---|---|---|
| 634114 | 1/1962 | Canada | 36/122 |
| 2409066 | 7/1979 | France | 36/124 |

*Primary Examiner*—B. Dayoan
*Attorney, Agent, or Firm*—Fields and Johnson, P.C.

[57] ABSTRACT

A snowshoe is provided with an integrally molded and supported hinge pin. A foot plate rotates about the hinge pin, and has mating structure which provides outstanding structural support, particularly during transverse loading conditions. The foot plate extends both forward and rearward of the hinge pin to further stabilize a wearer's foot. The bottom surface of the deck includes a plurality of traction ribs which also provide stiffening support to the deck. The mid portion of the deck is heavily reinforced with a plurality of mid support ribs which further stabilizes the hinge pin. A removable crampon plate attaches to the foot plate, and extends across the hinge pin. It may be adjusted to vary the depth of the engagement with the ground.

16 Claims, 5 Drawing Sheets

SNOWSHOE WITH INTEGRALLY MOLDED AND SUPPORTED HINGE PIN

TECHNICAL FIELD

This invention relates to a snowshoe and, more particularly, to a recreational snowshoe which is durable, simple in design and has reinforced construction to provide improved support during transverse loading conditions.

BACKGROUND ART

Snowshoeing as a recreational activity has become quite popular in recent years. In the snowshoe industry, injection molded snowshoes have become more common since they can be produced more economically. The advances in injection molding techniques have also allowed manufacturers to develop complex deck patterns and support structures for the deck which may achieve many objectives. One overall objective achieved by the use of injection molding is that materials, such as polycarbonate, can be used which are lightweight, durable, and inexpensive. Particularly for use by children, injection molded snowshoes are quite acceptable as their light weight makes it possible for children to enjoy snowshoeing.

One example of a molded plastic snowshoe is U.S. Pat. No. 3,638,333 to Sprandel. This reference discloses not only a molded plastic snowshoe, but also a one-piece molded plastic harness. Another example of an injection molded snowshoe of one-piece construction is U.S. Pat. No. 3,673,713 to Fedowitz. This reference discloses a snowshoe which maximizes lift with a small surface area by the use of valve flaps anchored downwardly which help to support a load, but also allow trapped snow to fall through the valve flaps once the foot is lifted. U.S. Pat. No. 5,014,450 to McGrath is yet another example of an injection molded snowshoe of one-piece construction. This snowshoe provides decking braces of L-shaped construction and openings to further reduce the weight of the snowshoe. While these references may be adequate for their intended purposes, each of them have shortcomings with respect to at least one of the advantages outlined below.

One overall objective of the invention is to provide a structurally simple, durable, and low maintenance snowshoe. It is also an overall objective to provide a snowshoe which is of a minimum size and weight which makes it available for use by children as well as adults.

It is one specific object of this invention to provide a snowshoe with an integrally molded and supported hinge pin which may withstand loading conditions not only induced longitudinally along the snowshoe, but also transversely when a wearer traverses uneven terrain. It is yet another object of the invention to provide a foot plate which forms part of the binding and which is rotatable about the hinge pin to not only allow a wearer's foot to rotate or perambulate in the characteristic snowshoe movement, but also to provide continuous support through the entire rotation. This continuous support helps to stabilize the wearer's foot gear with respect to the snowshoe. It is yet another object to provide a removable crampon attached to the foot plate which extends across the hinge pin to secure it in place and which may be adjustable to allow the wearer to choose the aggressiveness of the step. It is yet another object to provide the lower surface of the snowshoe with a tractor like lug pattern which assists not only in gripping the surface of the ground, but also in stripping away the snow and ice.

While the above advantages are specifically listed, other advantages will become apparent through analysis of the following description and drawings.

DISCLOSURE OF THE INVENTION

In its simplest form, the snowshoe of this invention includes three major components, namely, a platform, a foot plate, and a crampon plate. The platform is of one-piece construction formed by an injection molding process characterized by a deck plate with a large front opening which enables a portion of the wearer's foot to pass therethrough. Adjacent the front foot opening is an integral hinge pin extending transversely across the deck plate. The hinge pin is supported at least at one point along its length by a mid support which is an extension of the platform. One or more foot plate openings are formed on the platform rearwardly of the hinge pin, the function of the foot plate opening being discussed further below. Under the upper surface of the deck plate are a plurality of traction ribs and support ribs which provide rigidity to the deck plate as well as assistance in stripping snow or ice stuck to the bottom of the snowshoe.

The foot plate is rotatably mounted to the hinge pin by channels thereon. The foot plate includes a plurality of engagement supports or wiping ribs which matingly engage with structure on the deck plate which provides enhanced support and stability under all types of loading conditions to include transverse loading. The forward portion of the foot plate extends into the foot opening and, therefore, provides continuous support to the wearer's foot through all angles of rotation. Since the deck plate is rigid, it provides greater lift capability than snowshoes having a rigid frame and flexible deck. Accordingly, the deck plate may be made smaller which reduces weight and allows easier storage.

The crampon plate extends across the hinge pin to hold it in the foot plate channels and is adjustable so that a wearer may choose a more or less aggressive step position in icy conditions. The greater the distance the forward edge of the crampon is from the rotation point, the more aggressive the step because the crampon will dig deeper into the surface of the snow or ice.

The lower surface of the deck plate may also include a plurality of stiffening ribs, metal studs or other supports which assist in creating the desired amount of rigidity. These stiffening ribs may include mid support ribs found near the hinge pin which provide specific stiffening and support to that portion of the deck plate.

BEST MODE FOR CARRYING OUT THE INVENTION

Figure 1:
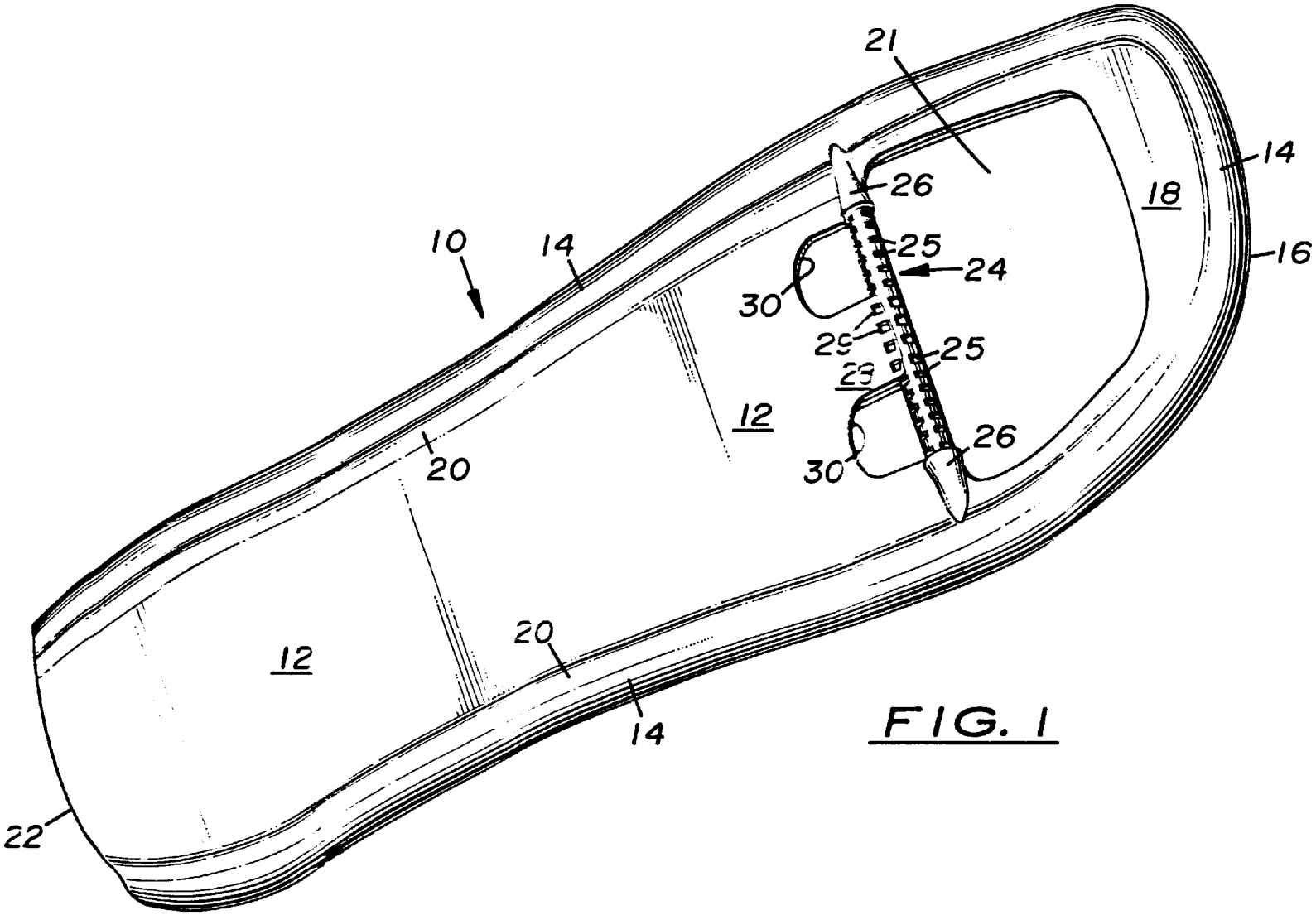
FIG. 1 is a perspective view of the snowshoe of this invention illustrating the upper surface of the deck plate with the foot plate removed.
Figure 2:
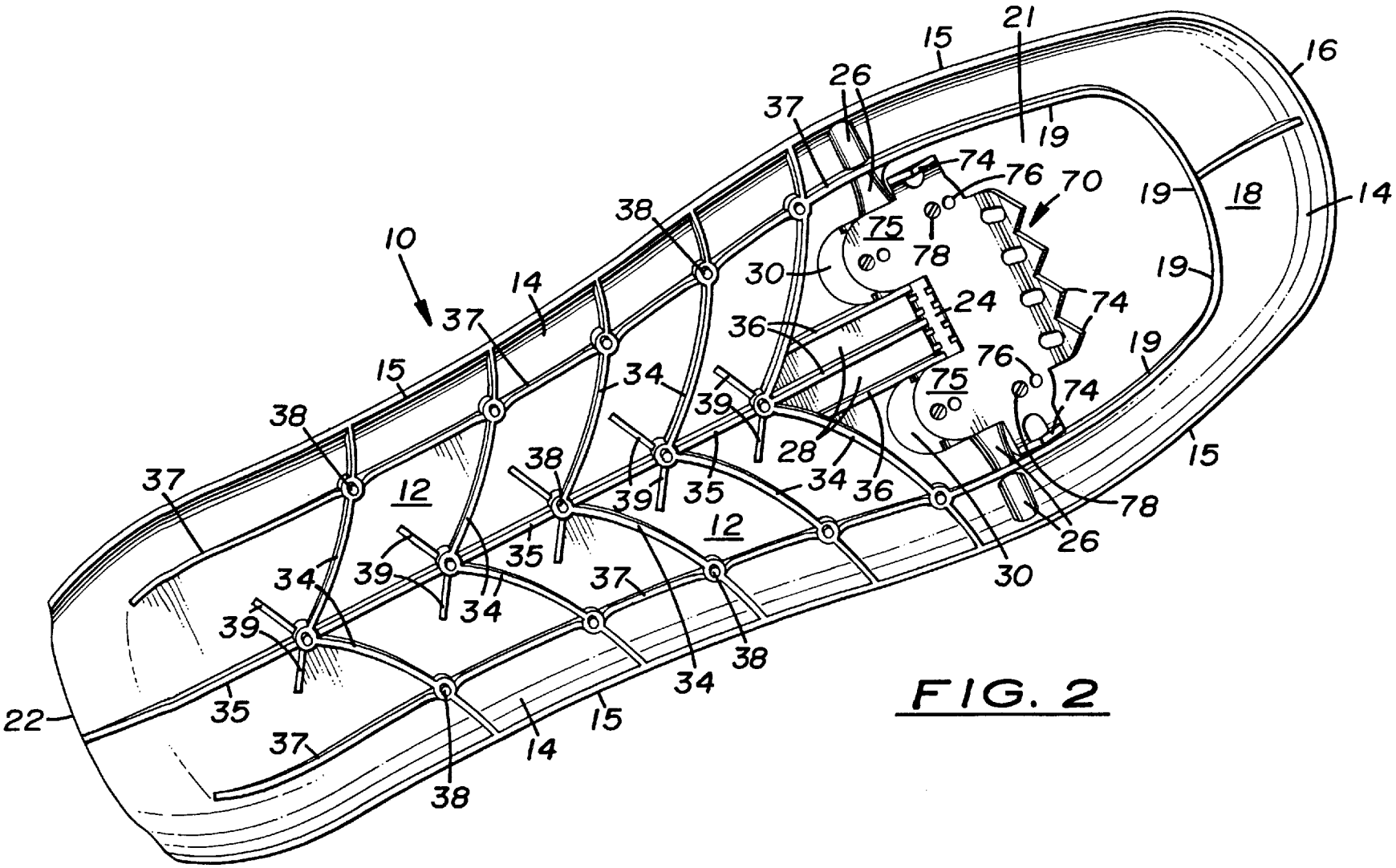
FIG. 2 is a bottom plan view showing the lower surface of the snowshoe with the foot plate and crampon plate in place.
Figure 8:
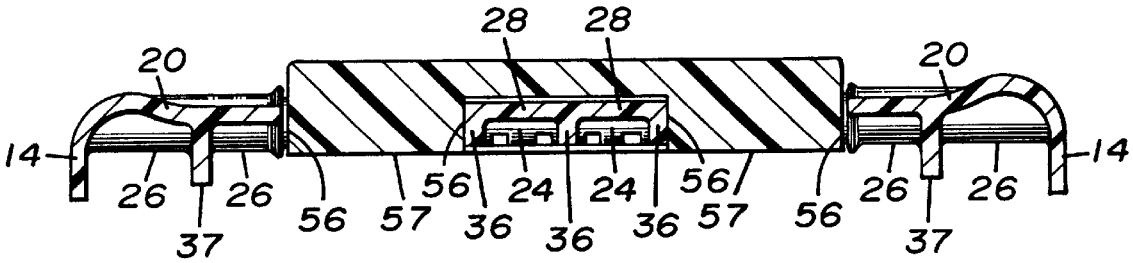
FIG. 8 is a vertical section, taken along Line 8—8 of FIG. 4, illustrating further details of the mounting of the foot plate to the hinge pin.

The snowshoe 10 of this invention as shown in FIGS. 1 and 2 includes a platform comprising an imperforate deck plate 12 which extends between a curved periphery 14. Between the deck plate 12 and the curved periphery 14 is a lateral transition area 20. Transition area 20 interconnects the more vertical and curved periphery 14 to the deck plate 12. As seen in FIG. 2, the lower surface of the curved periphery 14 terminates with a lower side edge 15 which provides some traction. The forward edge 16 of the deck plate 12 has a forward transitional toe area 18 extending inwardly from the curved periphery 14. Transition area 18 terminates at a lower edge 19 which also defines a large foot opening 21 and provides traction. Conveniently, edge 19 is generally parallel to forward edge 16 and side edge 15. The snowshoe 10 has a rear heel portion 22 which is simply a rear extension of the deck plate 12 and has no definable curved periphery 14 or transition area 20.

An integral hinge pin 24 traverses between opposing sides of the curved periphery 14 at the rear end of large foot opening 21. The ends of the hinge pin may be further defined as including hinge pin end supports 26 which extend outwardly through opposing sides of the transition area 20 of the curved periphery 14. The hinge pin 24 may have a plurality of hinge pin grooves 25 which have no specific functional purpose, and are formed as a result of the injection molding process. In injection molding, thicker structural members such as the hinge pin 24 are better and more uniformly molded when such grooves are formed in the mold. A hinge pin mid support 28 extends forward from deck plate 12 from the center of the rear end of large foot opening 21 to provide mid support to the hinge pin 24. As shown, mid support 28 also has a plurality of mid support grooves 29 which are formed in the injection molding process. The rear side of hinge pin 24 and the sides of mid support 28 define a pair of foot plate openings 30 on both sides of support 28. Although only a single mid support has been shown, it is contemplated within the scope of this invention that two or more laterally spaced supports could be used in place of single mid support 28.

As seen in FIG. 2, a plurality of curved traction ribs 34 are formed on the bottom surface of the deck plate 12. These traction ribs are substantially the same thickness as edges 15 and 37. As shown, ribs 34 begin adjacent lower edge 15 and extend in a rearward and curved fashion to the mid point of deck plate 12 defined by longitudinal center support rib 35. Traction ribs 34 terminate in V-shaped ribs 39 which extend on both sides of the center support rib 35. In addition to providing traction for the wearer, traction ribs 34 and 39 provide stiffening support to the deck plate 12. Also, there are a plurality of mid support ribs 36 which extend along hinge pin mid support 28 in order to provide additional stiffening strength specifically to the area of the deck plate 12 at the hinge pin 24. As shown, there are three mid support ribs 36 spaced laterally from one another. A peripheral support rib 37 is also formed on the interior side of curved periphery 14 as shown in FIG. 2. Peripheral support rib 37 can be thought of as continuous with lower edge 19 at the forward portion of the snowshoe and runs generally parallel to edge 15.

A plurality of ice cleats 38 may be installed in particularly icy conditions. As shown in FIGS. 2–5, ice cleats 38 are simply small metallic or plastic pins which are inserted within ice cleat mounts 40 which intersect and are longitudinally spaced along peripheral support rib 37. Additionally, a center row of ice cleats 38 may be used which have corresponding ice cleat mounts 40 extending along center support rib 35.

Figure 3:
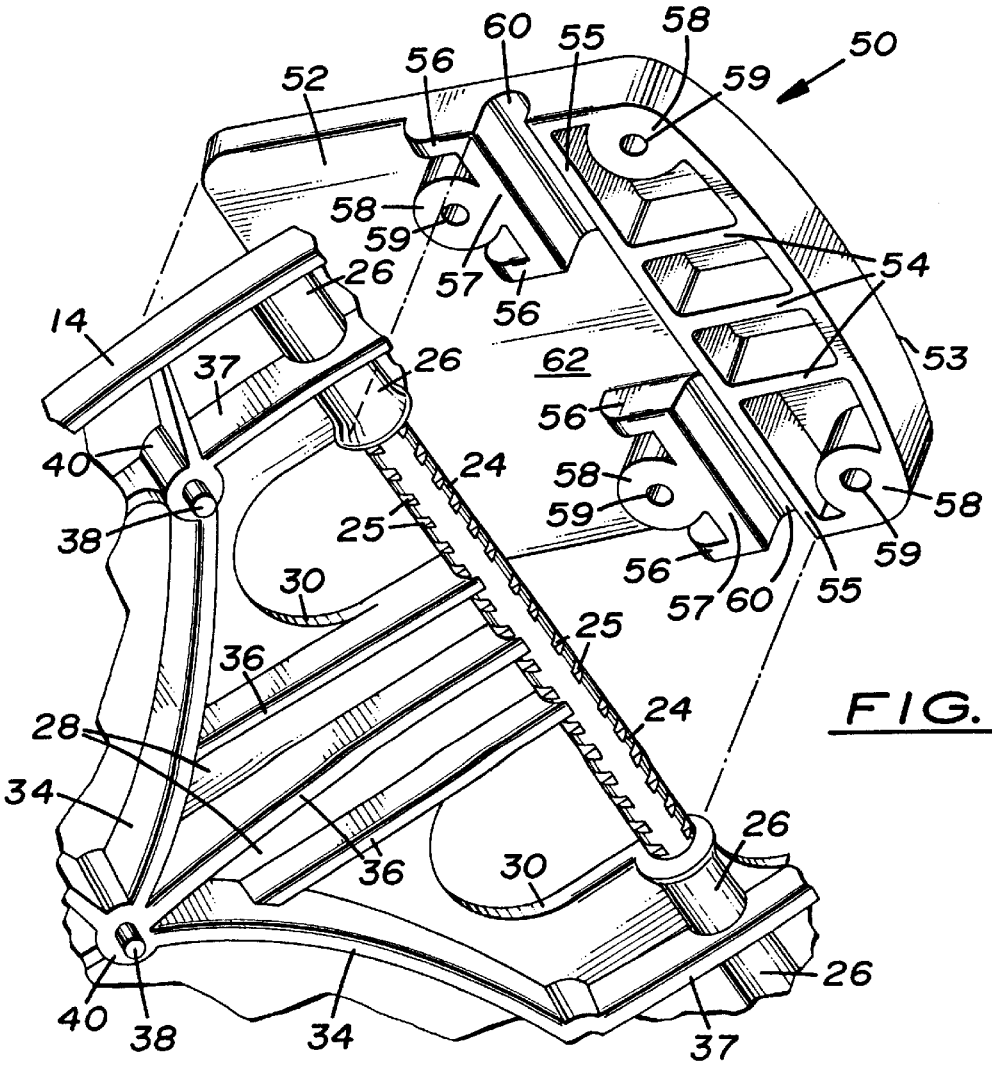
FIG. 3 is an enlarged fragmentary exploded bottom perspective view illustrating how the foot plate is mounted to the hinge pin.

Now referring to FIG. 3, foot plate 50 is shown prior to mounting on hinge pin 24. Foot plate 50 may also be made of a plastic material such as polycarbonate and may be injection molded. Foot plate 50 has a rear planar portion 52 and a forward edge 53. Near forward edge 53 is a plurality of longitudinal foot plate ribs 54 and an intersecting transverse foot plate rib 55. Ribs 54 and 55 provide additional strength to the foot plate. Rearward of transverse rib 55 are spaced pairs of longitudinal engagement supports 56 which are similar in thickness to ribs 54 and 55. A transverse engagement support 57 interconnects the two pairs of longitudinal engagement supports or wiping ribs 56. Rearward of transverse engagement supports 57 are a pair of crampon mounts 58 with holes 59 which serve as fastener supports. A pair of laterally spaced channels 60 are formed between the forward edges of transverse engagement supports 57 and the rear edge of transverse foot plate rib 55. These channels 60 are sized to snap onto and to receive hinge pin 24. In order to accommodate mid support 28, the lower surface of the foot plate 50 has an open center section 62 which separates and is formed by the pairs of supports 56, 57.

In operation, the foot plate 50 is simply snapped over hinge pin 24 so that the hinge pin is received in channels 60. The exposed surfaces of engagement supports 56 form edges which maintain sliding contact with the edges of each opening 50 from a horizontal position, substantially within the plane of deck plate 12 during rotation of the foot plate. In the horizontal position, supports 56, 57 are located within openings 30. The engagement supports 56 greatly improve the structural support in the connection between the foot plate 50 and the hinge pin 24, particularly in transverse loading conditions when the snowshoe placed on sloping or uneven terrain. Although contact is maintained between the exposed surfaces of engagement supports 56 and the edge of openings 30, such contact is not great enough that foot plate 50 is unable to rotate. Because the foot plate 50 extends on both the forward and rearward side of the hinge pin 34, a wearer's foot gear is supported to prevent any unnatural twisting of the foot during rotation which may normally occur on uneven terrain. Although not shown, any conventional type of binding straps may be used in conjunction with the foot plate to secure a wearer's foot thereto.

Figure 4:
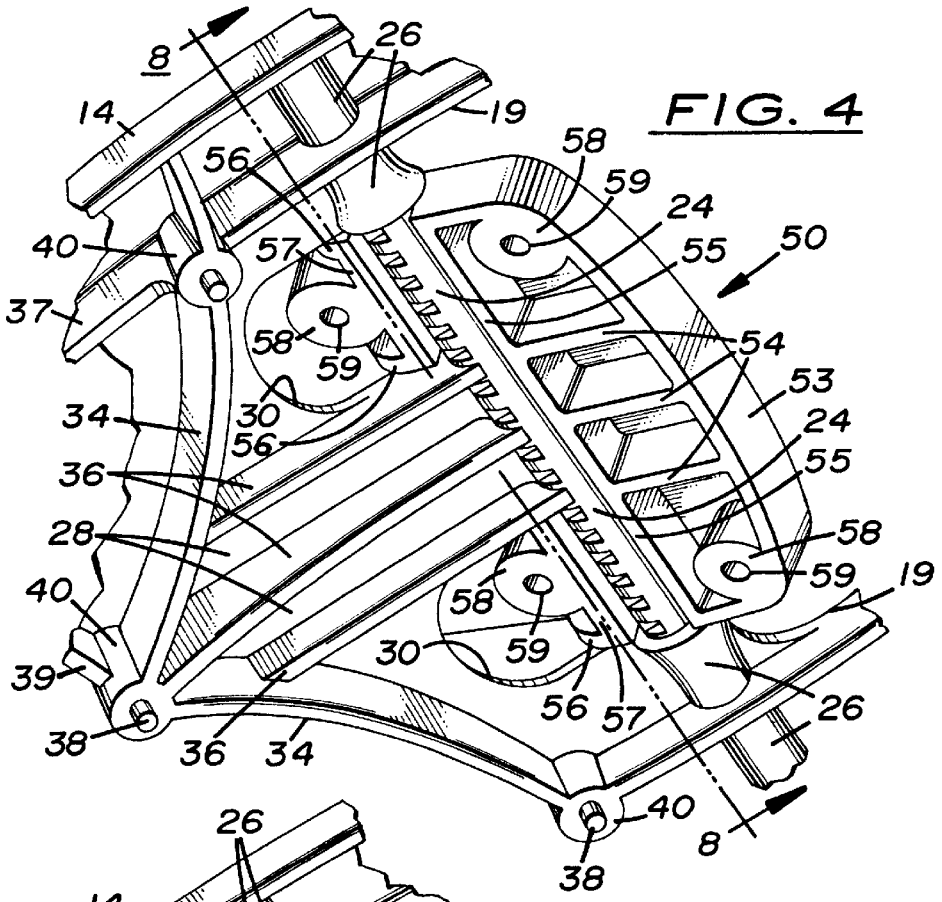
FIG. 4 is an enlarged fragmentary bottom perspective view, as shown in FIG. 3, illustrating the foot plate mounted to the hinge pin.
Figure 6:
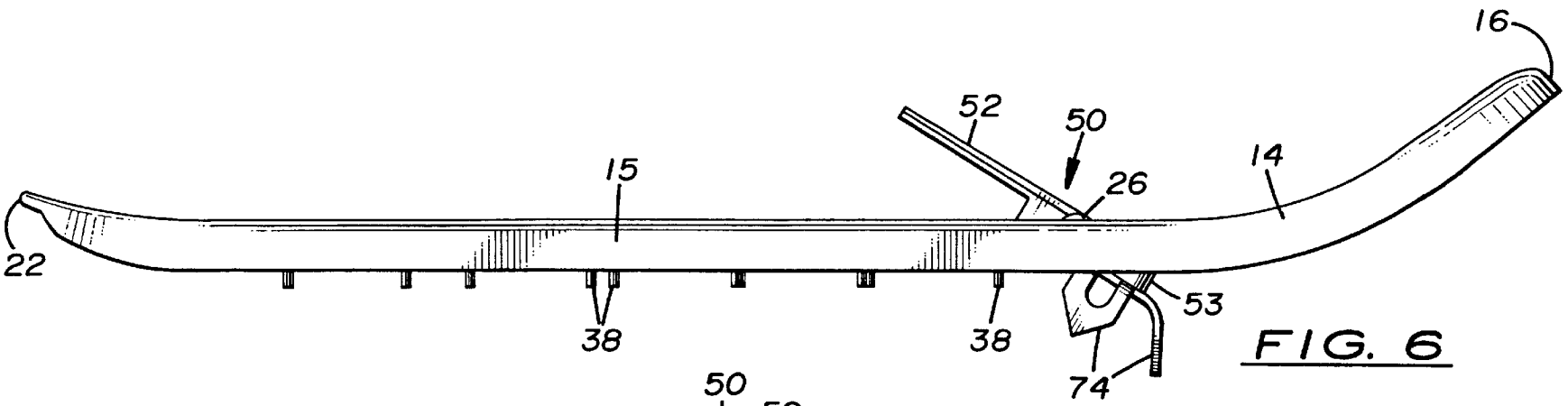
FIG. 6 is a side elevation of the snowshoe of this invention.
Figure 7:
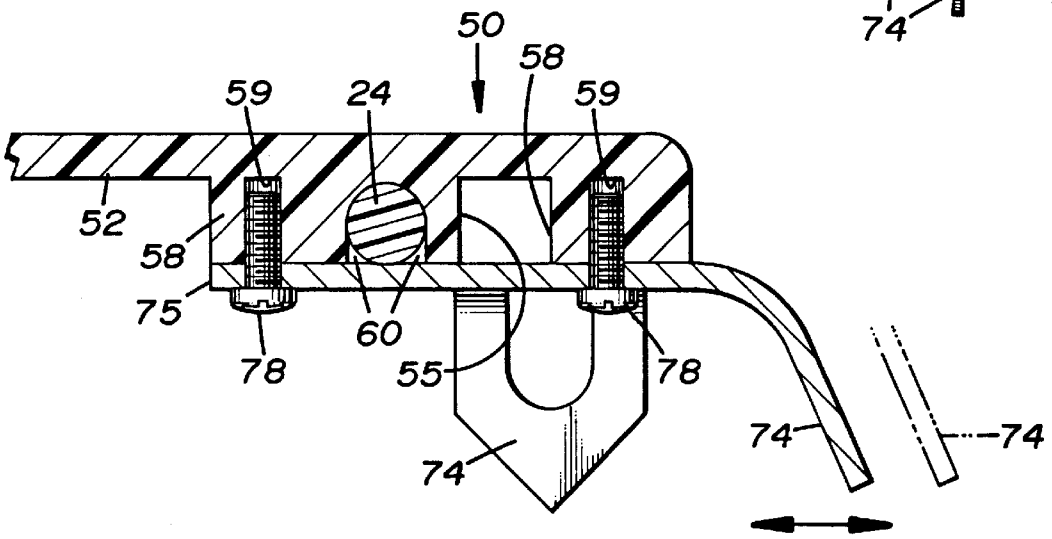
FIG. 7 is an enlarged vertical section, taken along Line 7—7 of FIG. 5, illustrating the crampon plate mounted to the foot plate, and the relationship of the hinge pin with respect to the foot plate.

FIGS. 4 and 6 illustrate the foot plate in its rotated position causing the heel of the wearer's foot to be raised and the forward edge 53 of foot plate 50 to be within large foot opening 32.

Figure 5:
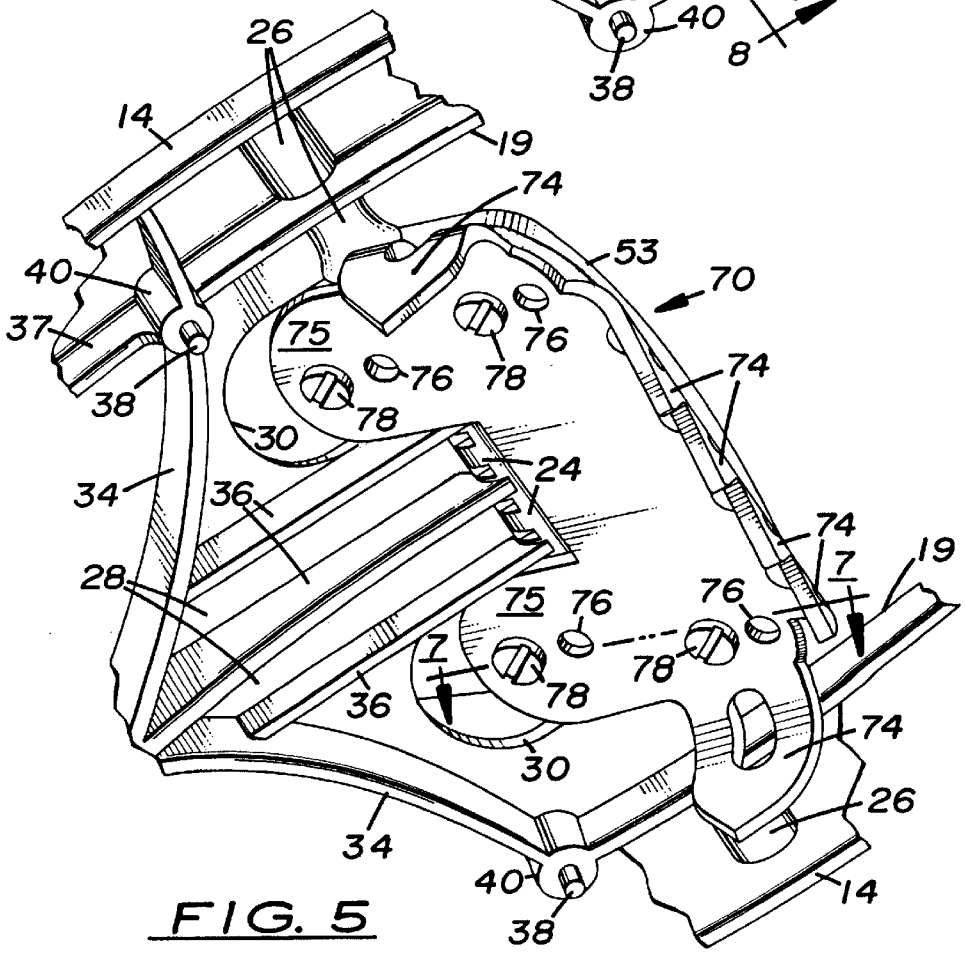
FIG. 5 is an enlarged fragmentary bottom perspective view, as shown in FIG. 4, further illustrating the crampon plate attached to the foot plate.

FIG. 5 illustrates crampon plate 70 mounted to foot plate 50. As shown, rear extensions 75 have openings 76 for receiving a plurality of fasteners 78 aligned with and fastened within openings 59. An additional set of longitudinally spaced holes 76 may be incorporated on the crampon plate 70 which enables a wearer to adjust the crampon for a more or less aggressive step. The actual gripping crampons 74 are formed on the forward exterior edge of the crampon plate 70. As shown, there are two side gripping crampons and four forward or front gripping crampons. As shown, extensions 75 of crampon plate 70 extend across channels 60 to further secure foot plate 50 on hinge pin 24.

By the disclosed invention, it is seen that a unitary molded deck plate is provided which has adequate structural support to withstand different loading conditions. The traction ribs along with the various other support ribs help to provide stiffening support to the deck plate, as well as to provide traction during use. The large and heavily supported hinge pin is able to withstand tremendous loads in comparison to many prior art snowshoes. Additionally, the large foot plate opening allows the foot plate to be pivoted out of the plane of the deck plate, the center pivoted foot plate ensures that both rear and forward portions of the foot are supported during rotation. Because of the use of the longitudinal engagement supports or wiping ribs 56, substantial structural support is provided in the connection between the deck plate and foot plate. The removable crampon plate provides a wearer with options in the degree of traction necessary or desired. Additionally, the ice cleats further enhance the wearer's ability to adjust the amount of traction, as necessary.

The apparatus of this invention is structurally simple, yet durable and requires little, if any, maintenance. Polycarbonate as a construction material is capable of withstanding very cold temperatures without decreased performance.

This invention has been described in detail with reference to a particular embodiment thereof, but it will be understood that various other modifications can be effected within the spirit and scope of this invention.

What is claimed is:

1. A snowshoe comprising:

a deck plate lying in a plane and having an upper surface, a lower surface, and a large foot opening formed on a forward portion thereof, said large foot opening having a rear edge;

an integrally molded hinge pin having first and second ends and extending laterally across said deck plate adjacent to and forwardly of said rear edge of said large foot opening;

a mid support, having an upper surface and a lower surface, integrally molded with said deck plate extending from said rear edge and attached to said hinge pin intermediate said first and second ends thereof to provide structural support therefor and forming with said rear edge a foot plate openings on either side of said mid support; and a foot plate having an upper surface, a lower surface, and a pair of laterally spaced channels formed on said lower surface extending transversely thereacross for rotatable engagement with said hinge pin on opposite sides of said mid support, said foot plate being rotatable from a first position in which it lies in said plane of said deck plate to a second position at an angle to said deck plate in which a portion of said foot plate which is forwardly of said hinge pin extends into said large foot opening.

2. A snowshoe, as claimed in claim 1, further including:

a first set of crampon mounts on said lower surface of said foot plate positioned rearwardly of said respective channels, said first set of crampon mounts being received in said foot plate openings when said foot plate is in said first position.

3. A snowshoe, as claimed in claim 2, wherein:

said first set of crampon mounts have edges in wiping engagement with said edges of said foot plate openings.

4. A snowshoe, as claimed in claim 3, wherein said first set of crampon mounts include:

a fastener support;

a transverse support formed integrally with each of said crampon mounts and having opposite ends; and a longitudinal engagement support extending rearwardly from each said end of said transverse supports, said longitudinal engagement supports forming said edges which are in wiping engagement with said edges of said foot support openings.

5. A snowshoe, as claimed in claim 4, further including:

a crampon plate, having a plurality of crampons extending away from said foot plate, said crampon plate extending across said lower surface of said foot plate so as to cover said hinge pin and hold said spaced channels on said hinge pin; and a first set of fasteners attaching said crampon plate to said first set of crampon mounts.

6. A snowshoe, as claimed in claim 5, wherein said foot plate has a depending front edge, further including:

a second set of crampon mounts on said lower surface of said foot plate and forwardly of said channels, said second set of crampon mounts being formed integrally with said front edge; and a second set of fasteners attaching said crampon plate to said second set of crampon mounts.

7. A snowshoe, as claimed in claim 6, wherein:

said crampon plate includes means for adjusting said crampon plate longitudinally along said bottom surface of said foot plate.

8. A snowshoe, as claimed in claim 7, wherein said adjusting means includes:

longitudinally spaced lateral pairs of openings for selectively receiving said first and second sets of fastening means.

9. A snowshoe, as claimed in claim 6, further including:

a transverse foot plate rib extending from said lower surface of said foot plate and located rearwardly of said second set of crampon mounts; and a plurality of spaced longitudinal foot plate ribs extending from said depending front edge to said transverse foot plate rib.

10. A snowshoe, as claimed in claim 1, further including:

a plurality of intersecting traction ribs extending from said lower surface of said deck plate.

11. A snowshoe, as claimed in claim 10, further including:

a center rib extending from and running longitudinally along said lower surface of said deck plate; and said traction ribs intersect said center rib.

12. A snowshoe, as claimed in claim 11, wherein:

said center rib extends along said lower surface of said mid support and further includes a mid support rib on the lower side of said mid support laterally spaced on opposite sides of said center rib and each intersecting one of said traction ribs.

13. A snowshoe, as claimed in claim 11, wherein:

said traction ribs are curved.

14. A snowshoe, as claimed in claim 11, further including:

a pair of support ribs each extending from said lower surface of said deck plate generally parallel to each side edge of said deck plate to provide stiffening support thereto.

15. A snowshoe, as claimed in claim 14, wherein said traction ribs intersect said support ribs and said center rib, further including:

ice cleats mounts at the intersection of said traction ribs with said center rib and said support ribs; and ice cleats mounted in at least some of said ice cleat mounts.

16. A snowshoe, as claimed in claim 1, further including:

a plurality of ice cleats extending from said a surface of said deck plate.

* * * * *